US009914605B2

(12) United States Patent
Watanabe

(10) Patent No.: US 9,914,605 B2
(45) Date of Patent: Mar. 13, 2018

(54) SHEET CONVEYANCE DEVICE AND IMAGE FORMING APPARATUS

(71) Applicant: CANON KABUSHIKI KAISHA, Tokyo (JP)

(72) Inventor: Kiyoshi Watanabe, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/050,228

(22) Filed: Feb. 22, 2016

(65) Prior Publication Data

US 2016/0244287 A1 Aug. 25, 2016

(30) Foreign Application Priority Data

Feb. 24, 2015 (JP) ..... 2015-034514
Dec. 28, 2015 (JP) ..... 2015-255878

(51) Int. Cl.

| | |
|---|---|
| ***B65H 5/38*** | (2006.01) |
| ***B65H 5/06*** | (2006.01) |
| ***B65H 29/52*** | (2006.01) |
| ***B65H 5/36*** | (2006.01) |
| ***G03G 21/16*** | (2006.01) |

(Continued)

(52) U.S. Cl.

CPC ..... *B65H 5/36* (2013.01); *B65H 5/062* (2013.01); *G03G 21/1638* (2013.01); *G03G 21/1647* (2013.01); *G03G 21/1695* (2013.01); *B65H 5/00* (2013.01); *G03G 15/6529* (2013.01); *G03G 15/6555* (2013.01);

(Continued)

(58) Field of Classification Search

CPC . B65H 5/38; B65H 5/062; B65H 5/06; B65H 29/52; G03G 21/1638

See application file for complete search history.

(56) References Cited

U.S. PATENT DOCUMENTS 7,548,723 B2 * 6/2009 Kang ..... G03G 15/6573 271/256
8,083,231 B2 * 12/2011 Hirata ..... B65H 5/38 271/273

(Continued)

FOREIGN PATENT DOCUMENTS

| | | |
|---|---|---|
| JP | 2001-063896 A | 3/2001 |
| JP | 2004-051361 A | 2/2004 |
| JP | 2008-87875 A | 4/2008 |

*Primary Examiner* — Luis A Gonzalez

(74) *Attorney, Agent, or Firm* — Canon U.S.A., Inc. IP Division

(57) ABSTRACT

If a damper or a magnetic catch is used to make a guide member self-holdable in an opened state, a force is required for holding the weight of the guide member in the opened state. This increases an operation force for closing the guide member and degrades the operability. In contrast, if a mechanical holding mechanism without using the damper is employed, the hold may be disengaged without intention of a user. A sheet conveyance device includes an upper conveyance guide for guiding a conveyed sheet and a holding portion for holding the upper conveyance guide in an opened position with respect to a lower conveyance guide opposed thereto, wherein the upper conveyance guide includes an operation portion for disengaging engagement between the upper conveyance guide and the holding portion, and the holding portion includes an operation portion for disengaging engagement between the upper conveyance guide and the holding portion.

25 Claims, 13 Drawing Sheets

(51) Int. Cl.
*B65H 5/00* (2006.01)
*G03G 15/00* (2006.01)

(52) U.S. Cl.
CPC ..... *G03G 2215/00544* (2013.01); *G03G 2215/00675* (2013.01); *G03G 2215/00679* (2013.01)

(56) References Cited

U.S. PATENT DOCUMENTS

| | | | |
|---|---|---|---|
| 8,478,165 | B2 | 7/2013 | Somemiya |
| 2002/0038932 | A1 | 4/2002 | Kaiga |

* cited by examiner

SHEET CONVEYANCE DEVICE AND IMAGE FORMING APPARATUS

BACKGROUND OF THE INVENTION

Field of the Invention

The present invention relates to a sheet conveyance device including an openable-closable guide member and an image forming apparatus including the sheet conveyance device.

Description of the Related Art

Conventionally, a sheet conveyance device has been provided with a configuration for opening a guide member included in a conveyance guide for solving paper jam arising in the conveyance guide. Some sheet conveyance devices employ guide members configured to be self-holdable in an opened state for solving the paper jam with one hand. A configuration for holding a guide member with a damper (see Japanese Patent Application Laid-Open No. 2008-87875) and a configuration for holding a guide member in an opened state with a magnetic catch have been provided as examples of the self holding method. Further, U.S. Pat. No. 8,478,165 discusses a guide configured to be closable and openable by engaging a fixed member provided on a cover member having the guide with a fixing member provided on a main unit, and disengaging the engagement.

However, the configuration using a damper is problematic in the following aspects. First, the damper is costly. Further, because the weight of the guide member is held in the opened state by the force of the damper, a user has to close the guide member against the force of the damper, and thus an operation force of the user is increased.

As for the configuration using a magnetic catch, similar to the configuration using a damper, the user has to close the guide member against the force of the magnetic catch, so that it is problematic in that the operation force of the user is increased.

Furthermore, in the configuration of closing and opening the guide member by engaging the fixed member with the fixing member and disengaging the engagement, the following problem may arise. Because the disengaging operation is performed by operating only a single member, there is such a risk that the guide member is opened or closed without intention of a user when the user touches, by mistake, the member for performing disengagement.

SUMMARY OF THE INVENTION

According to an aspect of the present invention, A sheet conveyance device includes a first guide member configured to guide a conveyed sheet, the first guide member comprising a first operation member provided to be movable with respect to the first sheet guide member, the first sheet guide member being provided to be pivotable with respect to a second sheet guide member, and a holding member configured to be engageable with the first guide member to hold the first sheet guide member at a first position. The holding member includes a first member and a second operation member provided to be movable with respect to the first member. In the case that the first sheet guide member is at the first position, movement of the first operation member in a first direction and movement of the second operation member in a second different direction disengage the first guide member and the holding member such that the first sheet guide member such that it is moveable from the first position to a second position, and the first guide member and the holding member remain engaged in the case that only one of the first operation member and the second operation member is moved in its respective direction.

Further features of the present invention will become apparent from the following description of embodiments with reference to the attached drawings. Each of the embodiments of the present invention described below can be implemented solely or as a combination of a plurality of the embodiments or features thereof where necessary or where the combination of elements or features from individual embodiments in a single embodiment is beneficial.

DESCRIPTION OF THE EMBODIMENTS

Hereinafter, embodiments of the present invention will be described in detail with reference to the appended drawings.

<Image Forming Apparatus>

Figure 1:
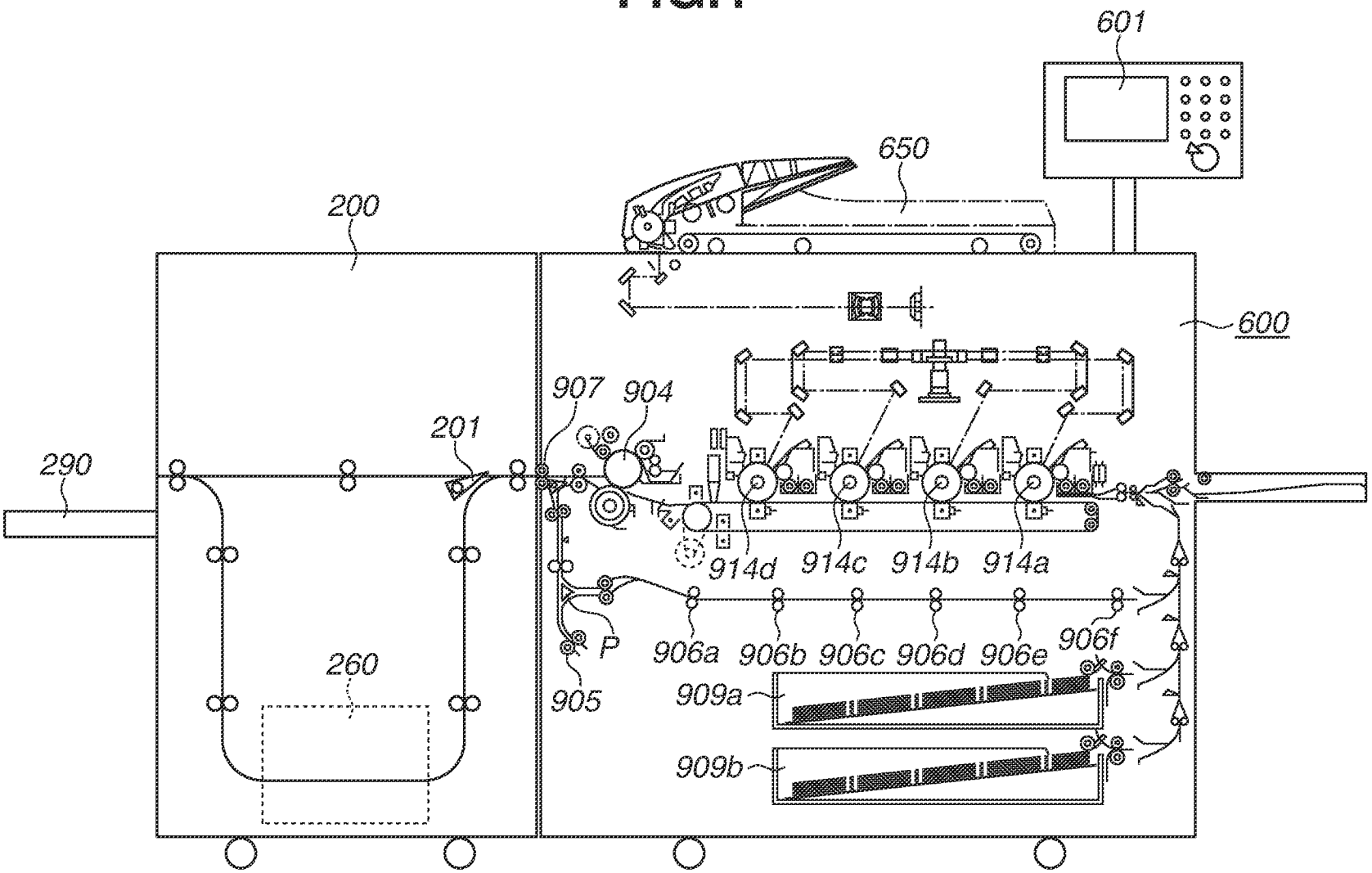
FIG. 1 is a cross-sectional view illustrating an image forming apparatus including a sheet processing device according to an embodiment of the present invention.

FIG. 1 is a diagram illustrating configurations of an image forming apparatus and a sheet processing device. In a first embodiment, an electro-photographic image forming apparatus will be described. As illustrated in FIG. 1, the image forming apparatus includes an image forming apparatus main unit 600 for executing black-and-white/color image formation, and a sheet processing device 200 and an image reading device 650 connected thereto. Therefore, a sheet discharged from the image forming apparatus main unit 600 can be processed by the sheet processing device 200 connected online. Further, the image forming apparatus main unit 600 can be independently used without connecting the sheet processing device 200 to a sheet discharge port. Furthermore, the sheet processing device 200 may be incorporated into the image forming apparatus main unit 600 as a sheet discharge device. Herein, a position where a user approaches an operation unit 601 for performing various inputs and settings to the image forming apparatus main unit 600 is referred to as a near front face side of the image forming apparatus (hereinafter, "front side"), whereas a rear face side of the image forming apparatus is referred to as a rear side. FIG. 1 is a diagram illustrating a configuration of the image forming apparatus viewed from the front side of the image forming apparatus. The sheet processing device 200 is connected to a side portion of the image forming apparatus main unit 600.

Through yellow, magenta, cyan, and black photosensitive drums 914*a* to 914*d* that constitute an image forming unit, a toner image in four colors is transferred onto a sheet S supplied from a cassette 909*a* or 909*b* included in the image forming apparatus main unit 600. Then, the sheet S is conveyed to a fixing device 904, where the toner image is fixed thereon and directly conveyed to the sheet processing device 200 by a discharge roller pair 907 in a case where processing is executed in a one-sided image forming mode. In case where the processing is executed in a two-sided image forming mode, the sheet S is transferred to an inversion roller 905 from the fixing device 904. When a trailing end of the sheet S in a conveyance direction passes over an inversion flapper P, the inversion roller 905 rotates in a reverse direction, so that the sheet S is conveyed in a direction of two-sided conveyance rollers 906*a* to 906*f*, which is a direction opposite to the conveyance direction. Then, a toner image in four colors is transferred onto a back side of the sheet S again through the yellow, magenta, cyan, and black photosensitive drums 914*a* to 914*d*. After the toner images are transferred onto the both sides thereof, the sheet S is conveyed to the fixing device 904 again, where the toner images are fixed onto the sheet S. Then, the sheet S is conveyed to the sheet processing device 200 by the discharge roller pair 907.

<Sheet Processing Device>

Figure 2:
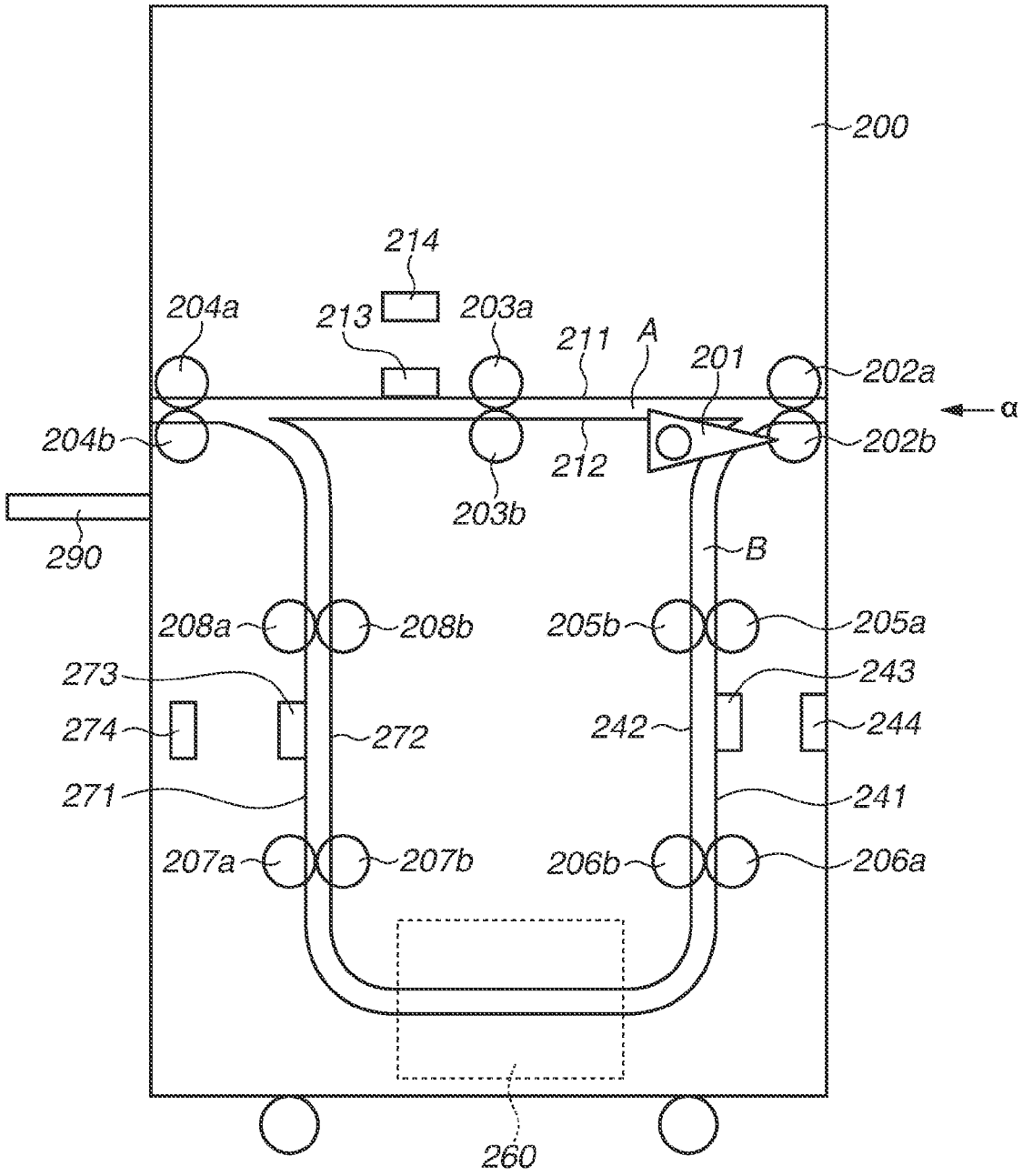
FIG. 2 is a cross-sectional view illustrating the sheet processing device according to an embodiment of the present invention.

FIG. 2 is a cross-sectional view of the sheet processing device 200. The sheet processing device 200 includes a processing path B through which the sheets discharged from the image forming apparatus main unit 600 are sequentially conveyed to a processing unit 260 that executes processing on the conveyed sheets, and a by-path A through which the sheets are discharged to a tray 290 on the downstream side in the conveyance direction without being processed. These paths A and B are switched by a flapper 201. Sheet processing includes punching processing for making a hole on a sheet and scoring processing for making a score on a sheet.

The sheet processing device 200 executes the sheet processing according to the user setting set through the operation unit 601 provided on the image forming apparatus main unit 600.

The sheet discharged from the image forming apparatus main unit 600 is transferred to a pair of inlet rollers 202*a* and 20*b* of the sheet processing device 200. In a case where no processing is executed on the sheet, the flapper 201 switches a path to the by-path A, so that the sheet is conveyed by pairs of conveyance rollers 203*a* and 203*b*, and 204*a* and 204*b*, and discharged to the tray 290 on the downstream side in the conveyance direction.

In a case where the processing is to be executed on the sheet, the flapper 201 switches a path to the processing path B, and the sheet is conveyed to the processing unit 260 by pairs of conveyance rollers 205*a* and 205*b*, and 206*a* and 206*b*, so that the processing is executed thereon. The processed sheet is conveyed again by pairs of conveyance rollers 207*a* and 207*b*, 208*a* and 208*b*, and 204*a* and 204*b*, and discharged to the tray 290 on the downstream side in the conveyance direction.

Figure 3:
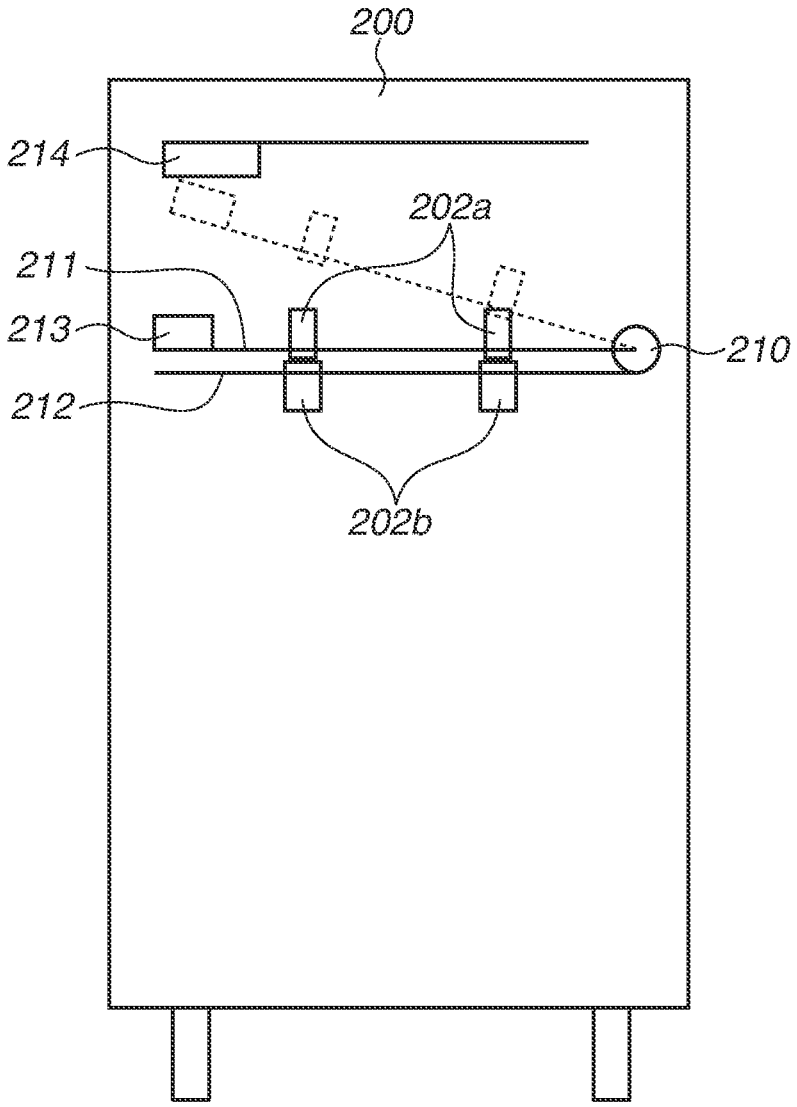
FIG. 3 is a side view illustrating a sheet processing device according to a first embodiment of the present invention, viewed from a side of an image forming apparatus.
Figure 4:
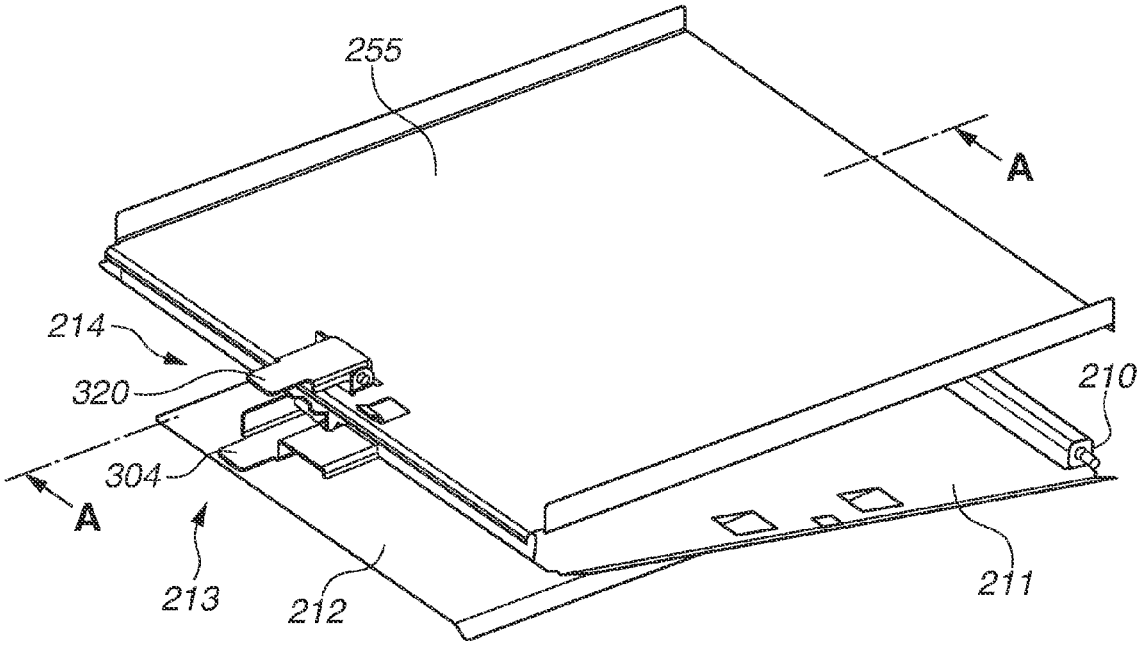
FIG. 4 is a perspective view illustrating a latch mechanism according to the first embodiment of the present invention.

The by-path A includes a guide mechanism 213 (i.e., first guide member or first sheet guide member) including an upper conveyance guide 211 (i.e., guide member), driven rollers 202*a*, 203*a*, and 204*a* mounted on the upper conveyance guide 211, a lower conveyance guide 212 (i.e., second guide member or second sheet guide member), and drive rollers 202*b*, 203*b*, and 204*b*. FIG. 3 is a side view illustrating the upper conveyance guide 211 and the lower conveyance guide 212 viewed from a side of the image forming apparatus 600 (i.e., viewed in a direction α in FIG. 2). FIG. 4 is a perspective view illustrating the upper conveyance guide 211 and the lower conveyance guide 212. As illustrated in FIGS. 3 and 4, the upper conveyance guide 211 is rotatably supported by a support shaft 210. The upper conveyance guide 211 is provided to be openable and closable with respect to the lower conveyance guide 212 opposed thereto, and configured to open upward with respect to the lower conveyance guide 212. At a position where the upper conveyance guide 211 is closed with respect to the lower conveyance guide 212, the upper conveyance guide 211 and the lower conveyance guide 212 are held in a closed state by a magnetic force of a magnet (not illustrated). A holding member 214 is provided at an opened position of the upper conveyance guide 211, so that the guide mechanism 213 of the upper conveyance guide 211 engages therewith. With this configuration, the upper conveyance guide 211 is held in an opened state, so that the operability for solving paper jam is improved. The upper conveyance guide 211 is a metallic guide having a plate structure.

On the inlet side of the processing unit 260, the processing path B includes an inlet fixed conveyance guide 242 and an inlet movable conveyance guide 241. The inlet movable conveyance guide 241 is rotatable similarly to the upper conveyance guide 211. When the inlet movable conveyance guide 241 is opened, a holding portion 244 engages with a held portion 243 of the inlet movable conveyance guide 241, so that the inlet movable conveyance guide 241 can be held in an opened state. On the outlet side of the processing unit 260, the processing path B includes an outlet fixed conveyance guide 272 and an outlet movable conveyance guide 271. The outlet movable conveyance guide 271 is rotatable similarly to the upper conveyance guide 211. When the outlet movable conveyance guide 271 is opened, a holding portion 274 engages with a held portion 273 of the outlet movable conveyance guide 271, so that the outlet movable conveyance guide 271 can be held in an opened state.

<Description of Latch Mechanism>

Figure 5:
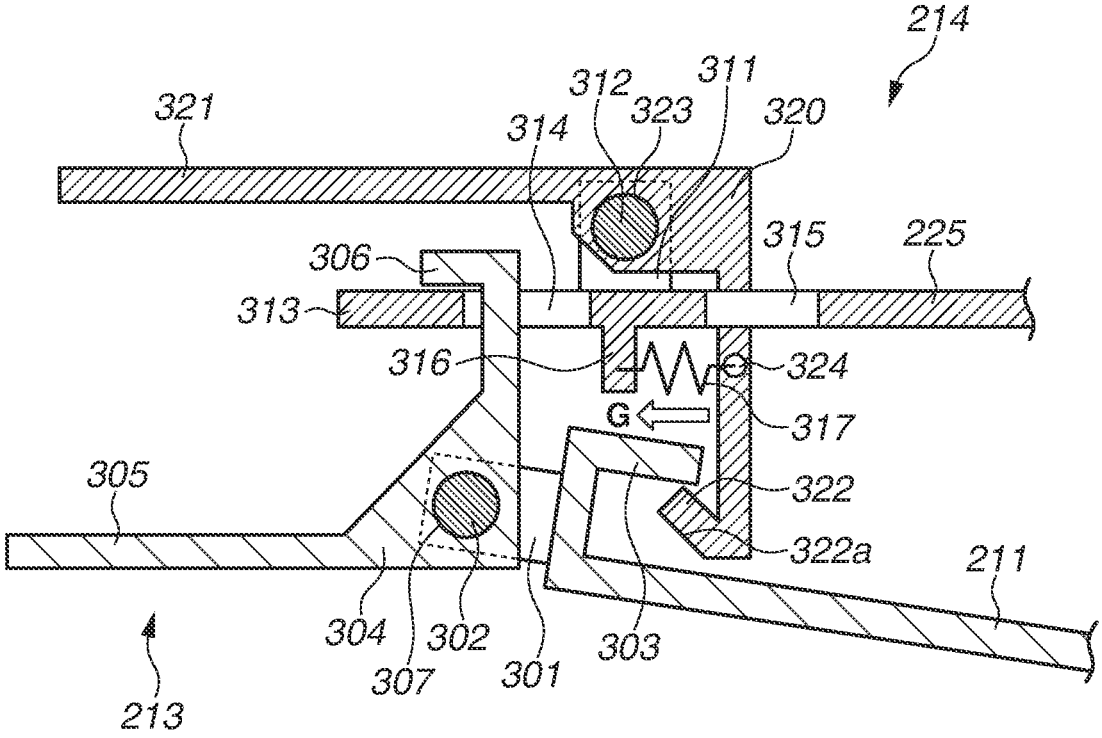
FIG. 5 is a cross-sectional view illustrating a latch mechanism according to the first embodiment of the present invention.
Figure 6:
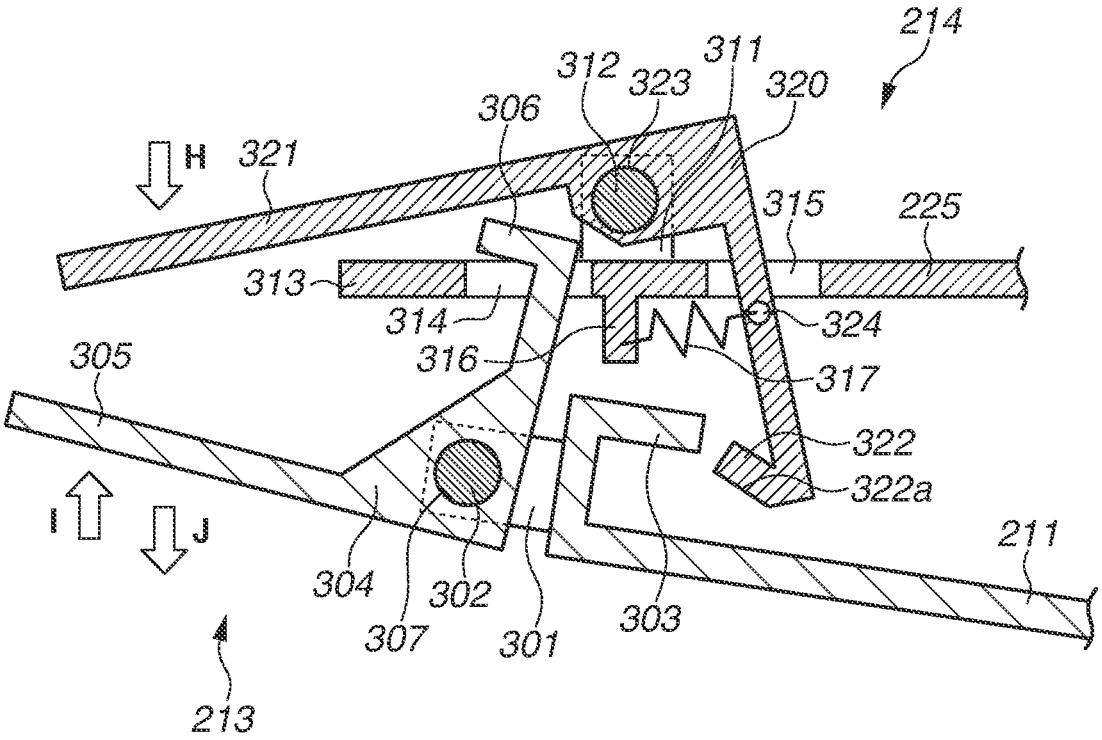
FIG. 6 is a cross-sectional view illustrating a latch mechanism according to the first embodiment of the present invention.

FIGS. 5 and 6 are cross-sectional views illustrating a configuration of a latch mechanism according to the present embodiment, and illustrate a state where the upper conveyance guide 211 rotates upward about the support shaft 210. FIGS. 5 and 6 are cross-sectional views taken along a line A-A in FIG. 4.

FIG. 5 is a diagram illustrating a state where the upper conveyance guide 211 is held in an opened position by the holding member 211 and the guide mechanism 213.

FIG. 6 is a diagram illustrating a state where the hold of the holding member 214 and the guide mechanism 213 is disengaged.

The holding member 214 includes a holding portion stay 225 (i.e., first member) fixed onto a frame (not illustrated) of the sheet processing device 200 and an operation stay 320 (i.e., second operation member) rotatable with respect to the holding portion stay 225. A support plate 311 standing on the holding portion stay 225 has a support shaft 312, and the support shaft 312 fits into a rotation hole 323 of the operation stay 320 to rotatably support the operation stay 320. Spring hook portions 324 and 316 are respectively provided on the operation stay 320 and the holding portion stay 225, and a tension spring 317 (i.e., urging portion) is hooked on the spring hook portions 324 and 316. The operation stay 320 is urged in a direction indicated by an arrow G in FIG. 5 by an elastic force of the tension spring 317. The operation stay 320 includes an operation portion 321 (i.e., second operation portion) operated by the user and an engaging portion 322 (i.e., second engaging portion). When the operation portion 321 is pressed in a direction (i.e., second direction) indicated by an arrow H in FIG. 6, the engaging portion 322 moves within a cutout hole 315 of the holding portion stay 225.

The guide mechanism 213 includes the upper conveyance guide 211 and a guide operation stay 304 (i.e., first operation member) supported to be rotatable with respect to the upper conveyance guide 211. A support plate 301 standing on the upper conveyance guide 211 has a support shaft 302, and the support shaft 302 fits into a rotation hole 307 of the guide operation stay 304 to rotatably support the guide operation stay 304. The guide operation stay 304 includes an operation portion 305 (i.e., first operation portion) and an engaged portion 306 (i.e., first engaged portion). When the operation portion 305 is pressed in a direction (i.e., first direction) indicated by an arrow I in FIG. 6, the engaged portion 306 moves within a cutout hole 314 of the holding portion stay 225. The operation portions 305 and 321 are provided on positions close to each other. Herein, the "positions close to each other" refer to a positional relationship that enables the user to simultaneously touch the operation portions 305 and 321 with one hand. Providing the two operation portions 305 and 321 on the positions close to each other enables the user to perform the operation with one hand. For example, the operation portions 305 and 321 are provided so that a distance between the operation portions 305 and 321 is equal to or less than 100 mm.

In a state where the upper conveyance guide 211 is held in the opened position, the operation stay 320 is urged by the tension spring 317, so that the engaging portion 322 engages with a fixed engaged portion 303 (i.e., second engaged portion) of the upper conveyance guide 211. Because the weight of the guide operation stay 304 is heavier on the side of the operation portion 305 than on the side of the engaged portion 306, as illustrated in FIG. 6, the moment that constantly rotates the guide operation stay 304 about the support shaft 302 in a direction indicated by an arrow J is applied to the guide operation stay 304. With this configuration, the engaged portion 306 is engaged with a fixed engaging portion 313 (i.e., first engaging portion) of the holding portion stay 225. Because the upper conveyance guide 211 is engaged using the engaging portions at two places, the holding state thereof is not disengaged only by operating either the operation stay 320 or the guide operation stay 304. For example, even if the user touches the guide operation stay 304 to cause the engaged portion 306 of the guide operation stay 304 to be disengaged from the fixed engaging portion 313, the holding state is not disengaged because the fixed engaged portion 303 is engaged with the engaging portion 322.

The engagement is disengaged by simultaneously operating a plurality of operation portions. This configuration can prevent the engaged state of the conveyance guide from being disengaged, and the conveyance guide from being damaged by suddenly failing onto the conveyance guide opposed thereto, even if the user operates only one of the operation portions by mistake. Further, because the operation portions are operated in different directions, the engaged state of the conveyance guide is not disengaged even if the user touches the operation portion by mistake.

In addition, the tension spring 317 is provided for holding the engaged state. When the user operates the operation portion 305 to engage the guide operation stay 304 with the holding portion stay 225, the fixed engaged portion 303 of the upper conveyance guide 211 moves along a slope portion 322*a* of the engaging portion 322 of the holding portion stay 225 against the tensile force of the tension spring 317. Then, when the fixed engaged portion 303 of the upper conveyance guide 211 passes over the slope portion 322*a*, the engagement between the fixed engaged portion 303 of the upper conveyance guide 211 and the engaging portion 322 of the holding portion stay 225 is held by the tension spring 317. Therefore, the user does not have to execute the engaging operation separately, and thus the operation load is reduced. In a configuration with no tension spring, the engaging portion 322 and the fixed engaged portion 303 are configured to tightly engage with each other (engaged state illustrated in FIG. 5), and the operation stay 320 is configured not to be operated.

When the engagement is to be disengaged, while the operation portion 321 of the operation stay 320 is being pressed in the direction indicated by the arrow H, the operation portion 305 of the guide operation stay 304 is pressed in the direction indicated by the arrow I, so that the engaging portion 322 and the engaged portion 306 are rotated. According to the configuration described in the present embodiment, the user does not have to apply a force against a force applied from a damper or a magnetic catch as described in the configuration using the damper or the magnetic catch. Thus, the user can close the upper conveyance guide 211 with a small operation force. Further, because the user can disengage the engagement by grasping the operation portion 321 of the operation stay 320 and the operation portion 305 of the guide operation stay 304, the user can easily perform the disengaging operation.

A second embodiment is different from the first embodiment only in a latch mechanism constituted by the holding member 214 and the guide mechanism 213 while the rest of the configurations are the same as those described in the first embodiment. Accordingly, only the latch mechanism will be described, and description of the configurations similar to those in the first embodiment will be omitted.

Figure 7:
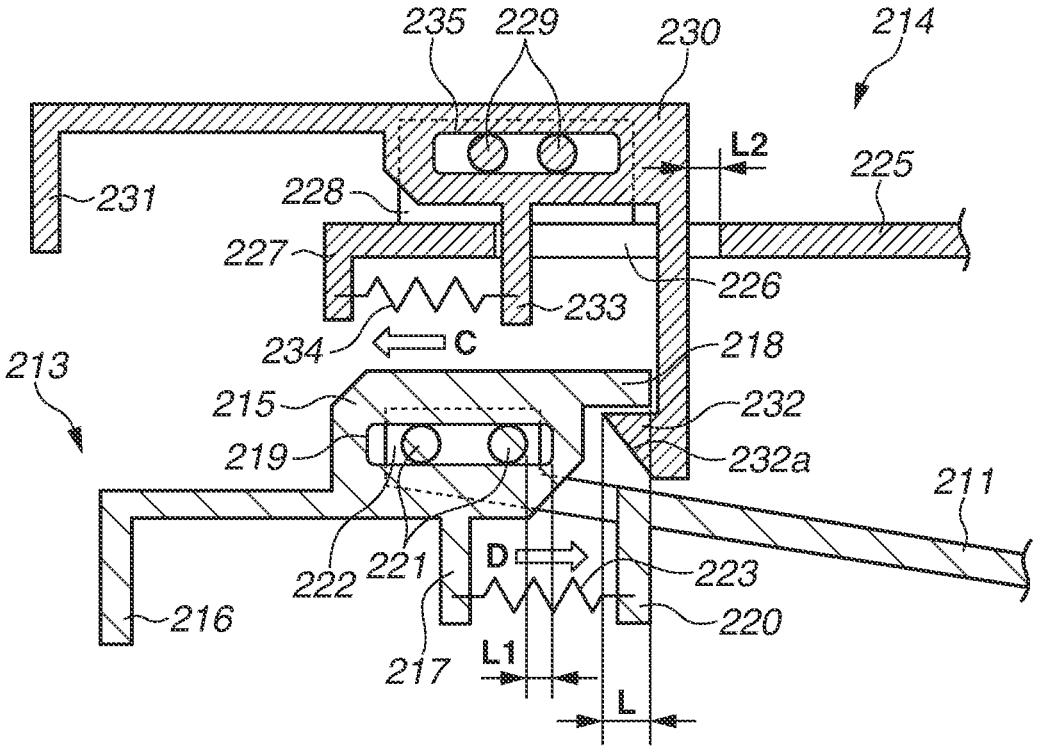
FIG. 7 is a cross-sectional view illustrating a latch mechanism according to a second embodiment of the present invention.
Figure 8:
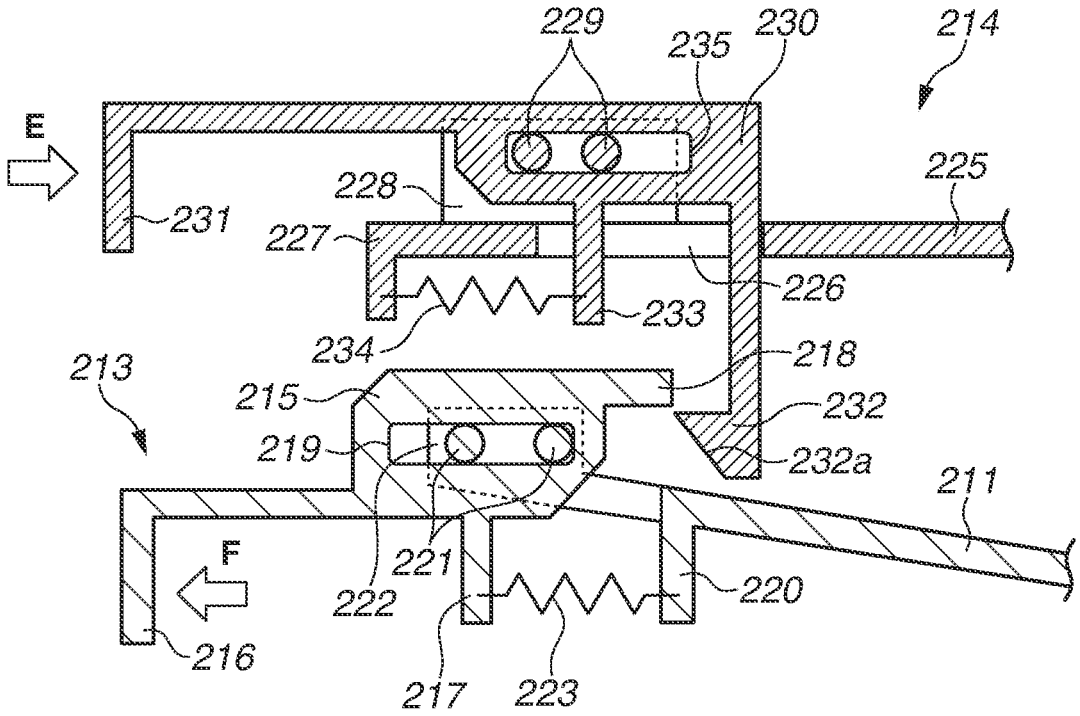
FIG. 8 is a cross-sectional view illustrating a latch mechanism according to the second embodiment of the present invention.

FIGS. 7 and 8 are cross-sectional views illustrating a configuration of the latch mechanism constituted by the holding member 214 and the guide mechanism 213 that is to be described below. FIGS. 7 and 8 illustrate a state where the upper conveyance guide 211 rotates upward about the support shaft 210.

FIG. 7 is a diagram illustrating a state where the upper conveyance guide 211 is held in an opened position by the holding member 214.

FIG. 8 is a diagram illustrating a state where the hold of the holding member 214 and the guide mechanism 213 is disengaged.

The holding member 214 includes a holding portion stay 225 fixed to a frame (not illustrated) of the sheet processing device 200 and an operation stay 230 (i.e., second operation member) slidable with respect to the holding portion stay 225. A support plate 228 standing on the holding portion stay 225 has two support shafts 229, and the support shafts 229 fit into a slide slit 235 of the operation stay 230 to slidably support the operation stay 230 spring hook portions 233 and 227 are respectively provided on the operation stay 230 and the holding portion stay 225, and a tension spring 234 (i.e., urging portion) is hooked on the spring hook portions 233 and 227. The operation stay 230 is urged in a direction indicated by an arrow C in FIG. 7 by an elastic force of the tension spring 234. The operation stay 230 includes an operation portion 231 (i.e., second operation portion) and an engaging portion 232 (i.e., first engaging portion). When the operation portion 231 is pressed in a direction (i.e., second direction) indicated by an arrow E in FIG. 8, the operation stay 230 moves by a movement amount L2 within a cutout hole 226 of the holding portion stay 225.

The guide mechanism 213 includes the upper conveyance guide 211 and a guide operation stay 215 (i.e., first operation member) provided on an end portion of the upper conveyance guide 211 on the opposite side of the support shaft 210. The guide operation stay 215 is supported to be slidable with respect to the upper conveyance guide 211. A support plate 222 standing on the upper conveyance guide 211 has support shafts 221, and the support shafts 221 fit into a slide slit 219 of the guide operation stay 215 to slidably support the guide operation stay 215. Spring hook portions 217 and 220 are respectively provided on the guide operation stay 215 and the upper conveyance guide 211, and a tension spring 223 (i.e., urging portion) is hooked on the spring hook portions 217 and 220. In addition, the guide operation stay 215 is urged in a direction indicated by an arrow D in FIG. 7 by an elastic force of the tension spring 223. The guide operation stay 215 includes an operation portion 216 (i.e., first operation portion) and an engaged portion 218 (i.e., first engaged portion). When the operation portion 216 is pressed in a direction (i.e., first direction) indicated by an arrow F in FIG. 8, the guide operation stay 215 slides by a slide or movement amount L1. The operation portions 216 and 231 are provided on positions close to each other. For example, the operation portions 216 and 231 are provided so that a distance between the operation portions 216 and 231 is equal to or less than 100 mm.

As illustrated in FIG. 7, when the upper conveyance guide 211 is held in an opened position, the operation stay 230 is urged by the tension spring 234 while the guide operation stay 215 is urged by the tension spring 223, so that the engaging portion 232 engages with the engaged portion 218 to hold the upper conveyance guide 211. The operation stay 230 and the guide operation stay 215 in this engagement relationship are not disengaged only by operating either the operation stay 230 or the guide operation stay 215. Slide or movement amounts of the respective operation portions 231 and 216 of the operation stay 230 and the guide operation stay 215 that are necessary for disengaging the engagement are each set to satisfy the following three relational expressions.

$$L>L1 \quad 1.$$

$$L>L2 \quad 2.$$

$$L<L1+L2 \quad 3.$$

By setting the slide or movement amounts L1 and L2 to satisfy the above relationships, even if the user touches and moves the guide operation stay 215 by the movement amount L1, the engagement is not disengaged because the movement amount L1 is smaller than the distance amount L required for disengaging the engagement between the operation stay 230 and the guide operation stay 215. Similarly, the engagement is not disengaged even if the user only touches the operation stay 230.

The engagement is disengaged by simultaneously operating a plurality of operation portions. This configuration can prevent the engaged state of the conveyance guide from being disengaged, and the conveyance guide from being damaged by suddenly falling onto the conveyance guide opposed thereto, even if the user operates one of the operation portions by mistake. Such damage to the conveyance guide becomes a noticeable problem when the conveyance guide is made of metal. Because the conveyance guide made of metal is heavier than the conveyance guide made of resin, an impact caused by the falling is greater.

In addition, the tension springs 223 and 234 are provided for holding the engaged state of the guide operation stay 215 and the operation stay 230. When the user operates the operation portion 216 to engage the guide operation stay 215 with the operation stay 230, the engaged portion 210 of the guide operation stay 215 moves along a slope portion 232*a* of the engaging portion 232 of the operation stay 230 against the tensile forces of the tension springs 223 and 234. Then, when the engaged portion 218 of the guide operation stay 215 passes over the slope portion 232*a*, the engagement between the engaged portion 218 of the guide operation stay 215 and the engaging portion 232 of the operation stay 230 is held by the tension springs 223 and 234. Therefore, the user does not have to execute the engaging operation separately, and thus the operation load is reduced. In a case where the tension springs are not provided, the user has to move the operation stay 230 and the guide operation stay 215 as appropriate to cause the engaged state.

When the engagement is to be disengaged, the operation portion 231 of the operation stay 230 is pressed in the direction indicated by the arrow E, the operation portion 216 of the guide operation stay 215 is pressed in the direction indicated by the arrow F to slide the engaging portion 232 and the engaged portion 218. According to the configuration described in the present embodiment, because the user does not have to apply a force against a force applied from a damper or a magnetic catch as described in the configuration using the damper or the magnetic catch, the user can close the upper conveyance guide 211 with a small operation force. While the engagement can be disengaged with a small operation force, a plurality of operation portions has to be operated in different directions for disengaging the engagement. Therefore, the holding state of the guide member can be prevented from being unintentionally disengaged even if the user touches one of the operation portions without intention.

A third embodiment is different from the first embodiment only in the latch mechanism constituted by the holding member 214 and the guide mechanism 213 while the rest of the configurations are the same as those described in the first embodiment. Accordingly, only the latch mechanism will be described, and description of the configuration similar to those in the first embodiment will be omitted.

Figure 9:
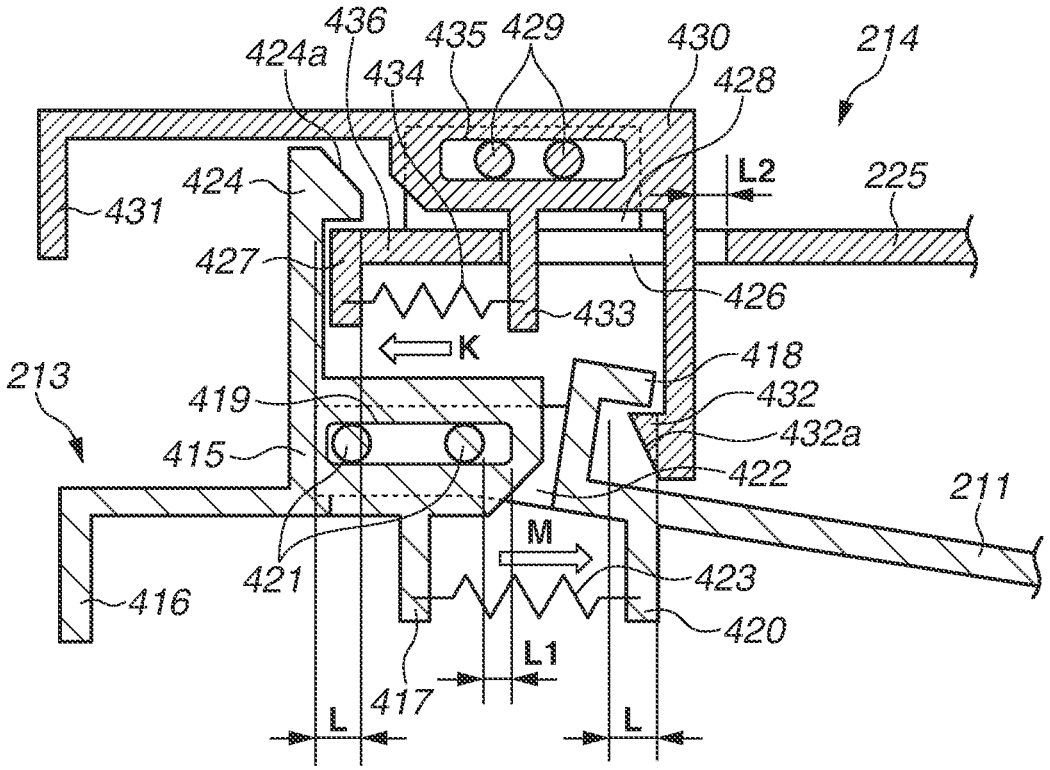
FIG. 9 is a cross-sectional view illustrating a latch mechanism according to a third embodiment of the present invention.
Figure 10:
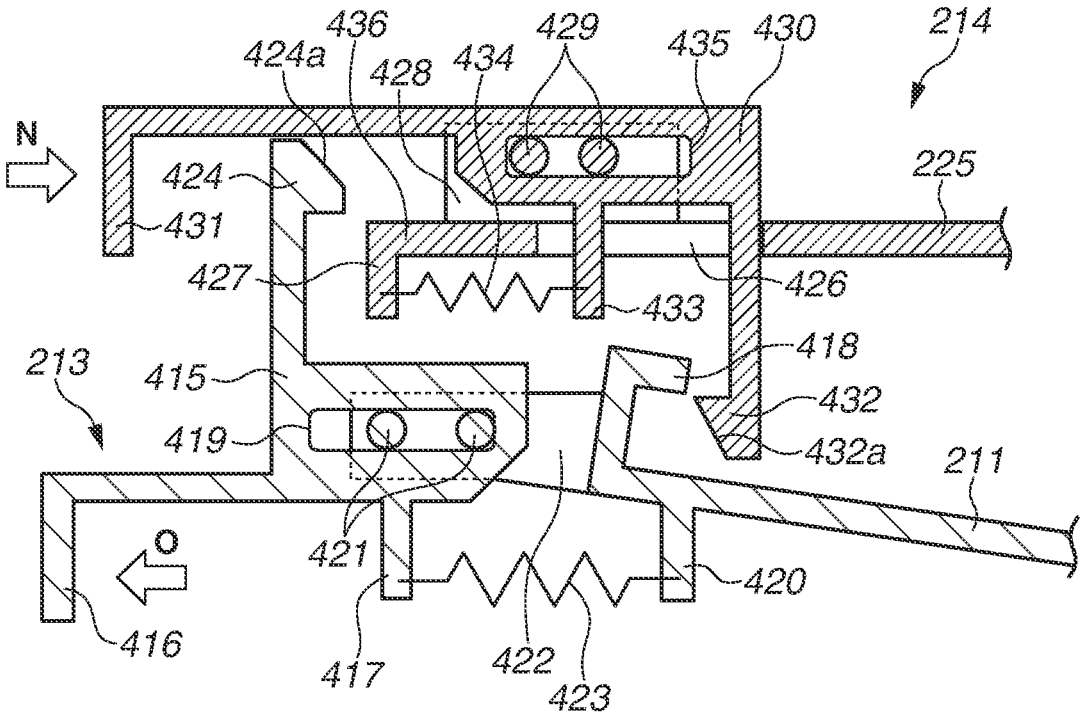
FIG. 10 is a cross-sectional view illustrating a latch mechanism according to the third embodiment of the present invention.

FIGS. 9 and 10 are cross-sectional views illustrating a configuration of the latch mechanism according to the present embodiment, and illustrate a state where the upper conveyance guide 211 rotates upward about the support shaft 210.

FIG. 9 is a diagram illustrating a state where the guide mechanism 213 is held in an opened position by the holding member 214.

FIG. 10 is a diagram illustrating a state where the hold of the holding member 214 and the guide mechanism 213 is disengaged.

The holding member 214 includes a holding portion stay 225 (i.e., first member) fixed to a frame (not illustrated) of the sheet processing device 200 and an operation stay 430 (i.e., second operation member) slidable with respect to the holding portion stay 225. A support plate 423 standing on the holding portion stay 225 has support shafts 429, and the support shafts 429 fit into a slide slit 435 of the operation stay 430 to slidably support the operation stay 430. Spring hook portions 433 and 427 are respectively provided on the operation stay 430 and the holding portion stay 225, and a tension spring 434 (i.e., urging portion) is hooked on the spring hook portions 433 and 427. In addition, the operation stay 430 is urged in a direction indicated by an arrow K in FIG. 9 by an elastic force of the tension spring 434. The operation stay 430 includes an operation portion 432 (i.e., second operation portion) and an engaging portion 432 (i.e., second engaging portion). When the operation portion 431 is pressed in a direction (i.e., second direction) indicated by an arrow N in FIG. 10, the operation stay 430 can move by a movement amount L2 within a cutout hole 426 of the holding portion stay 225.

The guide mechanism 213 includes the upper conveyance guide 211 and a guide operation stay 415 (i.e., first operation member) supported to be slidable with respect to the upper conveyance guide 212. A support plate 422 standing on the upper conveyance guide 211 has support shafts 421, and the support shafts 421 fit into a slide slit 419 of the guide operation stay 415 to slidably support the guide operation stay 415. Spring hook portions 417 and 420 are respectively provided on the guide operation stay 415 and the upper conveyance guide 211, and a tension spring 423 (i.e., urging portion) is hooked on the spring hook portions 417 and 420. In addition, the guide operation stay 415 is urged in a direction indicated by an arrow M in FIG. 9 by an elastic force of the tension spring 423. The guide operation stay 415 includes an operation portion 416 (i.e., first operation portion) and an engaged portion 424 (i.e., first engaged portion). When the operation portion 416 is pressed in a direction (i.e., first direction) indicated by an arrow O in FIG. 10, the guide operation stay 415 slides by a movement amount L1.

In a state where the upper conveyance guide 211 is held in an opened position, the operation stay 430 is urged by the tension spring 434, so that the engaging portion 432 engages with a fixed engaged portion 418 (i.e., second engaged portion) of the upper conveyance guide 211. The guide operation stay 415 is urged by the tension spring 423, so that the engaged portion 424 is engaged with a fixed engaging portion 436 (i.e., first engaging portion) of the holding portion stay 225.

The operation stay 430 and the guide operation stay 415 in this engagement relationship are not disengaged only by operating either the operation stay 430 or the guide operation stay 415. Slide amounts L1 and 12 of the respective operation portions 431 and 416 of the operation stay 430 and the guide operation stay 415 that are necessary for disengaging the engagement are each set to satisfy the following three relational expressions.

$$L>L1 \quad 1.$$

$$L>L2 \quad 2.$$

$$L<L1+L2 \quad 3.$$

Because the upper conveyance guide 211 is engaged using the engaging portions at two places, the holding state thereof is not disengaged only by operating either one of the operation stay 430 and the guide operation stay 415. For example, even if the user touches the guide operation stay 415 to cause the engaged portion 424 of the guide operation stay 415 to disengage from the fixed engaging portion 436, the holding state is not disengaged because the fixed engaged portion 413 is engaged with the engaging portion 432. The engagement is disengaged by simultaneously operating a plurality of operation portions. This configuration can prevent the engaged state of the conveyance guide from being disengaged, and the conveyance guide from being damaged by suddenly failing onto the conveyance guide opposed thereto, even if the user operates one of the operation portions by mistake.

In addition, the tension springs 423 and 434 are provided for improving the operability of the guide operation stay 415 and the operation stay 430. When the user operates the operation portion 416 to engage the guide operation stay 415 with the holding portion stay 225, a slope portion 424*a* the engaged portion 424 of the guide operation stay 415 is in contact with the fixed engaging portion 436 of the holding portion stay 225, so that the guide operation stay 415 moves against the tensile force of the tension spring 423. Further, a slope portion 432*a* of the engaging portion 432 of the operation, stay 430 is in contact with the fixed engaged portion 418 of the upper conveyance guide 211, so that the operation stay 430 moves against the tensile force of the tension spring 434. Thereafter, the engagement between the engaged portion 424 of the guide operation stay 415 and the fixed engaging portion 436 of the holding portion stay 225 is held by the tension spring 423. Further, the engagement between the engaging portion 432 of the operation stay 430 and the fixed engaged portion 418 of the upper conveyance guide 211 is held by the tension spring 434. Therefore, the user does not have to execute the engaging operation separately, and thus an operation load is reduced in a case where the tension springs are not provided, the user has to move the operation stay 430 and the guide operation stay 415 as appropriate to cause the engaged state.

When the engagement is to be disengaged, while the operation portion 431 of the operation stay 430 is being pressed in the direction indicated by the arrow N, the operation portion 416 of the guide operation stay 415 is pressed in the direction indicated by the arrow O to slide the engaging portion 432 and the engaged portion 424. According to the configuration described in the present embodiment, because the user does not have to apply a force against a force applied from a damper or a magnetic catch as described in the configuration using the damper or the magnetic catch, the user can close the upper conveyance guide 211 with a small operation force.

Figure 11:
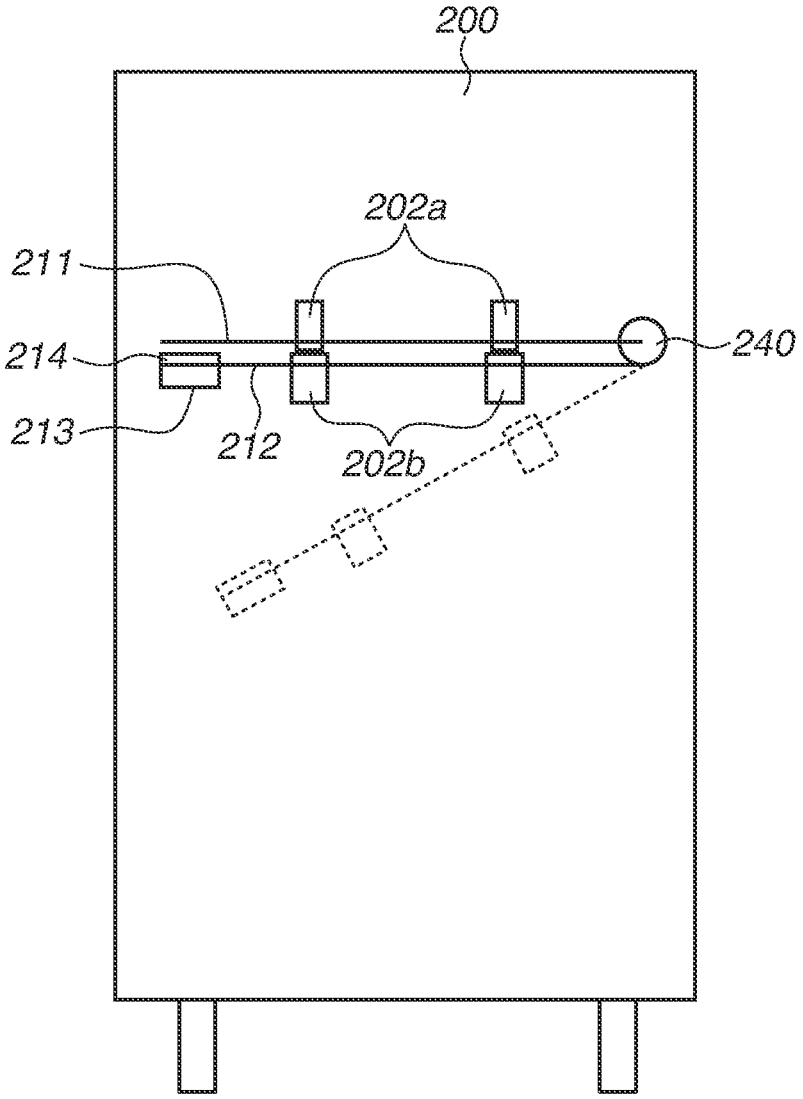
FIG. 11 is a side view illustrating a sheet processing device according to a fourth embodiment of the present invention, viewed from a side of an image forming apparatus.

A fourth embodiment is different from the second embodiment in an openable conveyance guide. FIG. 11 is a side view of the sheet processing device 200 viewed from a side of an image forming apparatus (i.e., viewed in a direction α in FIG. 2). In the present embodiment, a guide mechanism 213 (i.e., first guide member) includes a lower conveyance guide 212 and a guide operation stay 515 (i.e., first operation member). As illustrated in FIG. 11, the lower conveyance guide 212 (i.e., first guide member) is rotatably supported by a support shaft 240. The lower conveyance guide 212 is provided to be openable and closable with respect to an upper conveyance guide 211 (second guide member) opposed thereto. At a position where the lower conveyance guide 212 is closed with respect to the upper conveyance guide 211, the guide mechanism 213 engages with the holding member 214. The holding member 214 is provided on a position where the holding member 214 does not interrupt the conveyance of the sheet conveyed along the upper conveyance guide 211 and the lower conveyance guide 212. The configurations of the holding member 214 and the guide mechanism 213 are similar to those described in the second embodiment.

Figure 12:
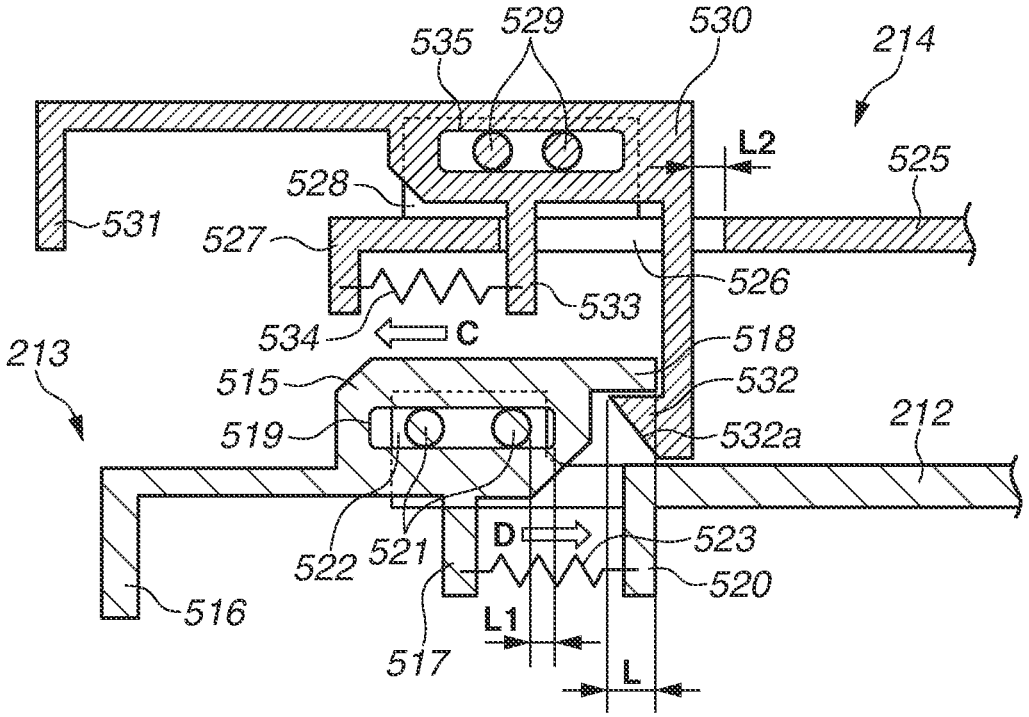
FIG. 12 is a cross-sectional view illustrating a latch mechanism according to the fourth embodiment of the present invention.
Figure 13:
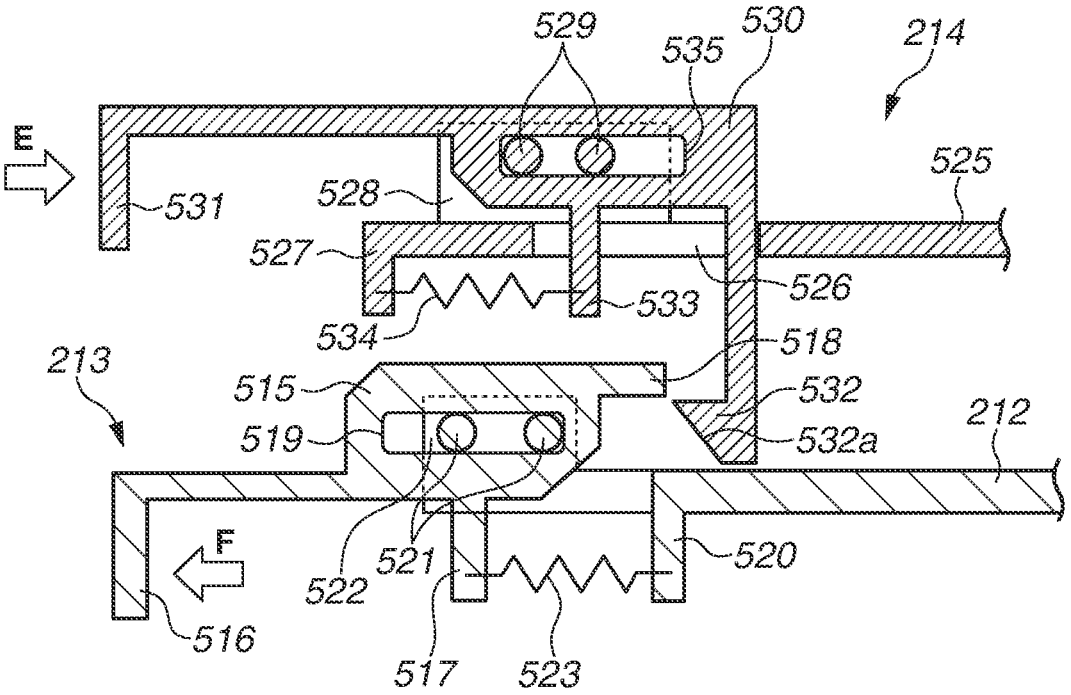
FIG. 13 is a cross-sectional view illustrating a latch mechanism according to the fourth embodiment of the present invention.

FIGS. 12 and 13 are cross-sectional views illustrating a configuration of the latch mechanism.

FIG. 12 is a diagram illustrating a state where the lower conveyance guide 212 is held in a position where the lower conveyance guide 212 is closed with respect to the upper conveyance guide 211, by the holding member 214 and the guide mechanism 213.

FIG. 13 is a diagram illustrating a state where the hold of the holding member 214 and the guide mechanism 213 is disengaged.

The holding member 214 includes a holding portion stay 525 (i.e., first member) fixed to a frame (not illustrated) of the sheet processing device 200 and an operation stay 530 (i.e., second operation member) slidable with respect to the holding portion stay 525. A support plate 528 standing on the holding portion stay 525 has support shafts 529, and the support shafts 529 fit into a slide slit 535 of the operation stay 530 to slidably support the operation stay 530. Spring hook portions 533 and 527 are respectively provided on the operation stay 530 and the holding portion stay 525, and a tension spring 534 (i.e., urging portion) is hooked on the spring hook portions 533 and 527. In addition, the operation stay 530 is urged in a direction indicated by an arrow C in FIG. 12 by an elastic force of the tension spring 534. The operation stay 530 includes an operation portion 531 (i.e., second operation portion) and an engaging portion 532 (i.e., first engaging portion). When the operation portion 531 is pressed in a direction (i.e., second direction) indicated by an arrow E in FIG. 13, the operation stay 530 can move by a movement amount L2 within a cutout hole 526 of the holding portion stay 525.

The guide mechanism 213 includes the lower conveyance guide 212 and the guide operation stay 515 (i.e., first operation member) supported to be slidable with respect to the lower conveyance guide 212. A support plate 522 standing on the lower conveyance guide 212 has support shafts 521, and the support shafts 521 fit into a slide slit 519 of the guide operation stay 515 to slidably support the guide operation stay 515. Spring hook portions 517 and 520 are respectively provided on the guide operation stay 515 and the lower conveyance guide 212, and a tension spring 523 (i.e., urging portion) is hooked on the spring hook portions 517 and 520. In addition, the guide operation stay 515 is urged in a direction indicated by an arrow D in FIG. 12 by an elastic force of the tension spring 523. The guide operation stay 515 includes an operation portion 516 (i.e., first operation portion) and an engaged portion 518 (i.e., first engaged portion). When the operation portion 516 is pressed in a direction. (i.e., first direction) indicated by an arrow F in FIG. 13, the guide operation stay 515 can slide by a movement amount L1. The operation portions 516 and 531 are provided on positions close to each other. For example, the operation portions 516 and 531 are provided so that a distance between the operation portions 516 and 513 is equal to or less than 100 mm.

As illustrated in FIG. 12, when the lower conveyance guide 212 is held in a closed position, the operation stay 530 is urged by the tension spring 534 while the guide operation stay 515 is urged by the tension spring 523, so that the engaging portion 532 engages with the engaged portion 518 to hold the lower conveyance guide 212. The operation stay 530 and the guide operation stay 515 in this engagement relationship are not disengaged by only operating either the operation stay 530 or the guide operation stay 515. Slide amounts L1 and L2 of the respective operation portions 531 and 516 of the operation stay 530 and the guide operation stay 515 that are necessary for disengaging the engagement are each set to satisfy the following three relational expressions.

$$L>L1 \quad (1.)$$

$$L>L2 \quad (2.)$$

$$L<L1+L2 \quad (3.)$$

By setting the slide amounts to satisfy the above relationships, even if the user touches and moves the guide operation stay 515 by the movement amount L1, the engagement is not disengaged because the movement amount L1 is smaller than the distance amount L required for disengaging the engagement between the operation stay 530 and the guide operation stay 515. Similarly, the engagement is not disengaged even if the user only touches the operation stay 530.

The engagement is disengaged by simultaneously operating a plurality of operation portions. This configuration can prevent the engaged state of the lower conveyance guide 212 from being disengaged, and the lower conveyance guide 212 from being damaged by suddenly falling, even if the user operates one of the operation portions by mistake. Such damage to the conveyance guide becomes a noticeable problem when the conveyance guide is made of metal. Because the conveyance guide made of metal is heavier than the conveyance guide made of resin, an impact caused by the falling is greater. In addition, the tension springs 523 and 534 are provided for holding the engaged state of the guide operation stay 515 and the operation stay 530. When the user operates the operation portion 516 to engage the guide operation stay 515 with the operation stay 530, the engaged portion 518 of the guide operation stay 515 moves along a slope portion 532*a* of the engaging portion 532 of the operation stay 530 against the tensile forces of the tension springs 523 and 534. Then, when the engaged portion 518 of the guide operation stay 515 passes over the slope portion 532*a*, the engagement between the engaged portion 518 of the guide operation stay 515 and the engaging portion 532 of the operation stay 530 is held by the tension springs 523 and 534. Therefore, the user does not have to execute the engaging operation separately, and thus the operation load is reduced in a case where the tension springs are not provided, the user has to move the operation stay 530 and the guide operation stay 515 as appropriate to cause the engaged state.

When the engagement is to be disengaged, while the operation portion 531 of the operation stay 530 is being pressed in the direction indicated by the arrow F, the operation portion 516 of the guide operation stay 515 is pressed in the direction indicated by the arrow F to slide the engaging portion 532 and the engaged portion 518. According to the configuration described in the present embodiment, because the user does not have to apply a force against a force applied from a damper or a magnetic catch as described in the configuration using the damper or the magnetic catch, the user can open the lower conveyance guide 212 with a small operation force.

Further, in the present embodiment, although the configuration of the latch mechanism described in the second embodiment is applied to a configuration of the holding mechanism of the lower conveyance guide 212, the configuration is not limited thereto. The latch mechanism described in the first or the third embodiment may be applied to the holding mechanism of the lower conveyance guide 212.

The holding structures of the upper conveyance guide 211 have been described in the first to the third embodiments and the holding structure of the lower conveyance guide 212 has been described in the fourth embodiment. In addition to the above structures, the latch mechanism described in each embodiment is applicable to a guide portion where the sheet is conveyed in a vertical direction, such as the inlet movable conveyance guide 241 and the outlet movable conveyance guide 271.

Further, although description has been given to the image forming apparatus of the electro-photographic system in the first to the fourth embodiments, the image forming system is not limited thereto. The present invention is also applicable to a sheet conveyance device used for an ink-jet image forming apparatus for forming an image by discharging ink onto a sheet.

The present application discloses a sheet conveyance device comprising: a first engaging member (213) coupled to a first sheet guide member (211), the first engaging member movable with respect to the sheet guide member (M) and the first sheet guide member (211) pivotable with respect to a second sheet guide member (212); a second engaging member (214) comprising a first member (225) and an engaging portion (320) which is movable with respect to the first member (225), and at least one of the first member (225) and the engaging portion (320) is arranged to engage with the first engaging member (213) to maintain the first sheet guide member (211) at a first position, wherein in the case that the first sheet guide member (211) is at the first position, movement of the first engaging member (213) in a first direction and movement of the second engaging member (320) in a second, different, direction disengages at least one of the first member (225) and the engaging portion (320) from the first engaging member such that the first sheet guide member (211) is moveable from the first position to a second position, and wherein the first engaging member (213) and the second engaging member (214) remain engaged in the case that only one of the first engaging member (304) and the second engaging member (320) is moved in its respective direction.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2015-034514, filed Feb. 24, 2015, and No. 2015-255878, filed Dec. 28, 2015, which are hereby incorporated by reference herein in their entirety.

What is claimed is:

1. A sheet conveyance device comprising:

a first guide member including a first sheet guide member configured to guide a conveyed sheet and a first operation member provided to be movable with respect to the first sheet guide member, the first sheet guide member being provided to be pivotable with respect to a second sheet guide member provided facing the first sheet guide member;

a holding member configured to be engageable with the first guide member to hold the first sheet guide member at a first position, wherein the holding member includes a first member and a second operation member provided to be movable with respect to the first member; and an urging portion configured to urge at least either one of the first operation member and the second operation member in a direction in which the urged operation member engages with the other one of the first operation member and the second operation member, wherein in the case that the first sheet guide member is at the first position, movement of the first operation member in a first direction and movement of the second operation member in a second direction different from the first direction disengage the first guide member and the holding member such that the first sheet guide member is moveable from the first position to a second position, and wherein the first guide member and the holding member remain engaged in the case that only one of the first operation member and the second operation member is moved in its respective direction.

2. The sheet conveyance device according to claim 1, wherein the first sheet guide member is provided to be upwardly pivotable with respect to the second sheet guide member.

3. The sheet conveyance device according to claim 1, wherein the first operation member is provided to be rotatable with respect to the first sheet guide member and the second operation member is provided to be rotatable with respect to the first member, and wherein engagement is disengaged by rotating the first operation member and the second operation member.

4. The sheet conveyance device according to claim 1, wherein the first operation member is provided to be slidable with respect to the first sheet guide member and the second operation member is provided to be slidable with respect to the first member, and wherein engagement is disengaged by sliding the first operation member and the second operation member.

5. The sheet conveyance device according to claim 4, wherein the following conditions are satisfied:

$$L>L1$$

$$L>L2$$

$$L<L1+L2,$$

where a slide amount of the first operation member is denoted by L1, a slide amount of the second operation member is denoted by L2, and a distance amount necessary for disengaging engagement is denoted by L.

6. The sheet conveyance device according to claim 1, wherein the first guide member is a metallic guide member.

7. The sheet conveyance device according to claim 1, wherein a portion of the first operation member that is operated by a user is a first operation portion and a portion of the second operation member that is operated by the user is a second operation portion, and wherein the first operation portion and the second operation portion are provided at positions which are close to each other such that a user can simultaneously operate both portions with one hand.

8. The sheet conveyance device according to claim 1, wherein a portion of the first operation member that is operated by a user is a first operation portion and a portion of the second operation member that is operated by the user is a second operation portion, and wherein the first operation portion and the second operation portion are arranged such that a distance between the first operation portion and the second operation portion is equal to or less than 100 mm.

9. A sheet conveyance device according to claim 1, wherein the first operation member comprises a first engaged portion, the first sheet guide member comprises a second engaged portion, the first member comprises a first engaging portion configured to engage with the first engaged portion, and the second operation member comprises a second engaging portion configured to engage with the second engaged portion, and wherein the holding member holds the first guide member by engagement between the first engaged portion and the first engaging portion and engagement between the second engaged portion and the second engaging portion, the engagement between the first engaged portion and the first engaging portion is disengaged by moving the first operation member in a first direction (I), and the engagement between the second engaged portion and the second engaging portion is disengaged by moving the second operation member in a second direction that is different from the first direction.

10. The sheet conveyance device according to claim 9, wherein the guide member is provided to be upwardly pivotable with respect to the second sheet guide member.

11. The sheet conveyance device according to claim 9, wherein the first operation member is provided to be rotatable with respect to the first sheet guide member and the second operation member is provided to be rotatable with respect to the first member, and wherein engagement is disengaged by rotating the first operation member and the second operation member.

12. The sheet conveyance device according to claim 9, wherein the first operation member is provided to be slidable with respect to the first sheet guide member and the second operation member is provided to be slidable with respect to the first member, and wherein engagement is disengaged by sliding the first operation member and the second operation member.

13. The sheet conveyance device according to claim 12, wherein the following conditions are satisfied:

$$L>L1$$

$$L>L2$$

$$L<L1+L2,$$

where a slide amount of the first operation member is denoted by L1, a slide amount of the second operation member is denoted by L2, and a distance amount necessary for disengaging engagement is denoted by L.

14. The sheet conveyance device according to claim 9, wherein the first guide member is a metallic guide member.

15. The sheet conveyance device according to claim 9, wherein a portion of the first operation member that is operated by a user is a first operation portion and a portion of the second operation member that is operated by the user is a second operation portion, and wherein the first operation portion and the second operation portion are provided at positions which are close to each other such that a user can simultaneously operate both portions with one hand.

16. The sheet conveyance device according to claim 9, wherein a portion of the first operation member that is operated by a user is a first operation portion and a portion of the second operation member that is operated by the user is a second operation portion, and wherein the first operation portion and the second operation portion are arranged such that a distance between the first operation portion and the second operation portion is equal to or less than 100 mm.

17. A sheet conveyance device comprising:

a first guide member including a first sheet guide member configured to guide a conveyed sheet and a first operation member provided to be movable with respect to the first sheet guide member, the first sheet guide member being provided to be pivotable with respect to a second sheet guide member provided facing the first sheet guide member;

a holding member configured to be engageable with the first guide member to hold the first sheet guide member at a first position, wherein the holding member includes a first member and a second operation member provided to be movable with respect to the first member; and an urging portion configured to urge at least either one of the first operation member and the second operation member in a direction in which the urged operation member engages with the other one of the first operation member and the second operation member, wherein the first operation member comprises a first engaged portion, wherein the second operation member comprises a first engaging portion configured to engage with the first engaged portion of the first operation member, wherein the holding member holds the first guide member by engagement between the first engaged portion and the first engaging portion, and wherein the engagement between the first engaged portion and the first engaging portion is disengaged by moving the first operation member in a first direction (F), and moving the second operation member in a second direction that is different from the first direction.

18. The sheet conveyance device according to claim 17, wherein the first sheet guide member is provided to be upwardly pivotable with respect to the second sheet guide member.

19. The sheet conveyance device according to claim 17, wherein the first operation member is provided to be slidable with respect to the first sheet guide member and the second operation member is provided to be slidable with respect to the first member, and wherein engagement is disengaged by sliding the first operation member and the second operation member.

20. The sheet conveyance device according to claim 19, wherein the following conditions are satisfied:

$$L>L1$$

$$L>L2$$

$$L<L1+L2,$$

where a slide amount of the first operation member is denoted by L1, a slide amount of the second operation member is denoted by L2, and a distance amount necessary for disengaging engagement is denoted by L.

21. The sheet conveyance device according to claim 17, wherein the first guide member is a metallic guide member.

22. The sheet conveyance device according to claim 17, wherein a portion of the first operation member that is operated by a user is a first operation portion and a portion of the second operation member that is operated by the user is a second operation portion, and wherein the first operation portion and the second operation portion are provided at positions which are close to each other such that a user can simultaneously operate both portions with one hand.

23. The sheet conveyance device according to claim 17, wherein a portion of the first operation member that is operated by a user is a first operation portion and a portion of the second operation member that is operated by the user is a second operation portion, and wherein the first operation portion and the second operation portion are arranged such that a distance between the first operation portion and the second operation portion is equal to or less than 100 mm.

24. A sheet conveyance device comprising:

a first guide member including a first sheet guide member configured to guide a conveyed sheet and a first operation member provided to be movable with respect to the first sheet guide member, the first sheet guide member being provided to be pivotable with respect to a second sheet guide member provided facing the first sheet guide member; and a holding member configured to be engageable with the first guide member to hold the first sheet guide member at a first position, wherein the holding member includes a first member and a second operation member provided to be movable with respect to the first member, wherein engagement is disengaged by sliding the first operation member and the second operation member, wherein in the case that the first sheet guide member is at the first position, movement of the first operation member in a first direction and movement of the second operation member in a second direction different from the first direction disengage the first guide member and the holding member such that the first sheet guide member is moveable from the first position to a second position, wherein the first guide member and the holding member remain engaged in the case that only one of the first operation member and the second operation member is moved in its respective direction;

wherein the first operation member is provided to be slidable with respect to the first sheet guide member and the second operation member is provided to be slidable with respect to the first member, and wherein engagement is disengaged by sliding the first operation member and the second operation member.

25. A sheet conveyance device comprising:

a first guide member including a first sheet guide member configured to guide a conveyed sheet and a first operation member provided to be movable with respect to the guide member, the first sheet guide member being provided to be pivotable with respect to a second sheet guide member provided facing the first sheet guide member; and a holding member configured to be engageable with the first guide member to hold the first sheet guide member a first position, wherein the holding member includes a first member and a second operation member provided to be movable with respect to the first member, wherein the first operation member comprises a first engaged portion, wherein the second operation member comprises a first engaging portion configured to engage with the first engaged portion of the first operation member, wherein the holding member holds the first guide member by engagement between the first engaged portion and the first engaging portion, and wherein the engagement between the first engaged portion and the first engaging portion is disengaged by moving the first operation member in a first direction, and moving the second operation member in a second direction that is different from the first direction, wherein the first operation member is provided to be slidable with respect to the first sheet guide member and the second operation member is provided to be slidable with respect to the first member, and wherein engagement is disengaged by sliding the first operation member and the second operation member.

* * * * *